US007018429B1

(12) United States Patent
Wenstrup

(10) Patent No.: US 7,018,429 B1
(45) Date of Patent: Mar. 28, 2006

(54) PROCESS FOR COLORING A TEXTILE SUBSTRATE

(75) Inventor: David E. Wenstrup, Easley, SC (US)

(73) Assignee: Milliken & Company, Spartanburg, SC (US)

( * ) Notice: Subject to any disclaimer, the term of this patent is extended or adjusted under 35 U.S.C. 154(b) by 169 days.

(21) Appl. No.: 09/586,202

(22) Filed: Jun. 2, 2000

(51) Int. Cl.
*B05D 1/38* (2006.01)
*B05C 1/06* (2006.01)
*D06P 1/17* (2006.01)

(52) U.S. Cl. ..... 8/501; 8/492; 8/147; 427/381; 427/500

(58) Field of Classification Search ..... 8/115.53, 8/115.55, 115.56, 149, 501, 492, 147; 427/500, 427/381; 534/800
See application file for complete search history.

(56) References Cited

U.S. PATENT DOCUMENTS 3,775,054 A * 11/1973 DeVinney ..... 8/149
3,918,111 A * 11/1975 Dunn ..... 8/149.1
4,045,601 A * 8/1977 Brodmann et al. ..... 427/381
4,087,494 A 5/1978 Reinehr et al. ..... 264/78
4,095,940 A 6/1978 Weingarten ..... 8/15
4,902,787 A 2/1990 Freeman ..... 534/800
5,066,308 A 11/1991 Yeh et al. ..... 8/403
5,376,151 A 12/1994 Freeman et al. ..... 8/685

* cited by examiner

*Primary Examiner*—Yogendra N. Gupta
*Assistant Examiner*—Preeti Kumar
(74) *Attorney, Agent, or Firm*—Terry T. Moyer; Robert M. Lanning

(57) ABSTRACT

The present invention relates to methods of imparting color and ultraviolet protection to synthetic yarns or substrates. More specifically, the present invention is directed to a method of solution dyeing a polymeric material during polymerization to form a base color shade, and subsequently dyeing the polymeric material by either yarn dyeing or piece dyeing. Ultraviolet protection is also provided in the solution dyeing step, by introducing an ultraviolet stabilizing agent into the polymer. The base shade may then be transformed into a useful color pallet with enhanced lightfastness properties by applying a final color shade late in the fabric formation process.

4 Claims, No Drawings

PROCESS FOR COLORING A TEXTILE SUBSTRATE

BACKGROUND OF THE INVENTION

1. Field of the Invention

The present invention relates to methods of imparting color and ultraviolet protection to synthetic yarns or substrates. More specifically, the present invention is directed to a method of solution dyeing a polymeric material during polymerization to form a base color shade, and subsequently dyeing the polymeric material by either yarn dyeing or piece dyeing. Ultraviolet protection is also provided in the solution dyeing step, by introducing an ultraviolet stabilizing agent into the polymer. The base shade may then be transformed into a useful color pallet with enhanced lightfastness properties.

It is well known in the textile arts to use solution dyeing techniques in order to dispose colors integrally within polymeric fibers. Additionally, it is also well known in the art to provide an agent to impart ultraviolet protection to the substrate by the addition of an ultraviolet stabilizer, or other ultraviolet protective agent, in this process. Generally, the process involves adding some colorant, such as pigment or dye, into the polymerization process.

Another common dyeing technique is yarn dyeing, which simply entails dyeing the yarn before it is made into a fabric or substrate. Yarns may be dyed in skeins or packages. In skein dyeing, large, loosely wound skeins of yarn are placed in a vat for dyeing. In package dyeing, the yarn is wound onto a number of perforated tubes or springs, and the dye is circulated around and through the tubes to assure that the yarns have maximum contact with the dyestuff.

Piece dyeing is a technique generally used when fabrics are to be dyed one solid color. In piece dyeing, the finished fabric is passed through a dyebath in which the fabric absorbs the dyestuff. Piece dyeing includes such methods as beck dyeing, jet dyeing, jig dyeing, beam dyeing, pad dyeing, vacuum impregnation, and foam dyeing, among others.

The solution dyeing technique is known to produce very colorfast materials, because the color is locked into the polymer itself. However, the number of yarn styles and colors that are solution dyed is limited for economic reasons. The fiber manufacturer must produce substantial quantities of fiber to justify the expense of adding an extra step during the manufacturing process. Furthermore, fiber production takes place well in advance of the time when fabrics reach the market. Fashion color trends may change fairly rapidly, so that, by the time a solution dyed fabric reaches the market, the color may be out of fashion. For these reasons, solution dyed fabrics are generally basic large volume styles and colors constructed from standard yarns.

Piece dyeing and yarn dyeing offer more color flexibility than solution dyeing, because these processes are further downstream in the manufacturing process. Because these methods tend to impart dyestuff to the outer portions of the yarn or substrate, and the color is not integrated within the polymeric structure, the colorfastness level is not as high as those levels achieved by solution dyeing.

Therefore, it would be desirable to provide a method of coloring a substrate that would allow substrates to be dyed in a wide variety of colors, and would provide a high level of colorfastness (and particularly lightfastness). Further, it would be desirable to provide a method of coloring substrates where the inventory of solution dyed substrates would consist of a few base shades that could be transformed by other dyeing methods into a wide variety of colors and shades. This method would reduce waste in the form of unused solution dyed substrates, obsolete yarn, and would allow reduced lead times on customer color orders. Additional benefits would include reduced inventory carrying costs and reasonable economies of scale in yarn production.

2. Description of the Prior Art

All U.S. patents referenced below are incorporated herein by reference, in their entirety.

U.S. Pat. No. 4,902,787, issued to Freeman, discloses a method of producing a UV lightfast disperse dyestuff comprising selecting a disperse dyestuff having predetermined chromophoric groups, selecting a photostabilizer compound, designing a hybrid disperse dye molecular structure which contains the chromophoric groups of the selected disperse dyestuff and also contains the molecular strucrural features of the selected photostabilizer compound, and synthesizing the thus designed hybrid disperse dyestuff molecule. This method produces a hybrid dye molecule which is a UV lightfast analog of a disperse dyestuff having predetermined chromophoric groups, where the hybrid dye molecule contains in its molecular structure the chromophoric groups of the selected disperse dyestuff and also contains the molecular structural features of a photostabilizer compound.

U.S. Pat. No. 5,376,151, issued to Freeman, et al., teaches methods for both the synthesis of metallized dyes and the generation of black dyeings using those dyes without employing metals designated as priority pollutants. The problems addressed in this reference are associated with the use of Cr-based metallized azo dyes to deliver black shades on natural and synthetic substrates. The key element of the disclosure is the use of black 1:2 Fe complexes of azo dyes in lieu of currently used Cr-based complexes which are based on environmentally unfriendly priority pollutant metals without compromising the desirable high fastness properties of the latter complexes.

U.S. Pat. No. 5,478,603, issued to Smith, is directed to an improved process for providing fibrous polyamide materials and wool materials with stain resistance and superior lightfastness that are more durable against alkaline washing. This is accomplished by treating the materials with an aqueous solution comprising a combination of a partially sulfonated novolak resin, methacrylic polymer and a soluble aluminum compound or a combination of a partially sulfonated novolak resin and a soluble aluminum compound.

None of the prior art, however, utilizes a combination of internal or solution dyeing with an external dye technique such as yarn dyeing or piece dyeing to produce a yarn or substrate having improved lightfast characteristics relative to external dyeing techniques alone. Further, none of the prior art offers a solution to the economic problems associated with the production of solution dyed yarn, as discussed above, particularly regarding the problems of waste, inefficiency, obsolescence, and inventory.

OBJECTS OF THE INVENTION

Accordingly, an important object of the present invention is to provide a method of combining solution dyeing (internal) techniques with other dyeing (external) techniques yielding a substrate exhibiting colors that have improved durable lightfastness.

Another important object of the present invention is to provide a method for producing a substrate in a wide variety of lightfast, final color shades, which are derived from a single base color shade.

Yet another important object of the present invention is to provide a method of manufacturing dyed substrates, where an intermediate inventory comprises solution dyed substrates having a base color shade, which can be ultimately transformed into a wide variety of final color shades.

Still another important object of the present invention is to provide a dyed substrate that has been solution dyed (internally) and also either yarn or piece dyed (externally).

Another important object of the present invention is to provide a method that utilizes internal dyeing, external dyeing, and also internally imparts ultraviolet radiation protection to a textile substrate.

These and other features, aspects and advantages of the present invention will become better understood with reference to the following description and appended claims.

DESCRIPTION OF THE PREFERRED EMBODIMENT

The process of the present invention discloses a method of combining solution dyeing with other types of surface or external dyeing to produce a colored substrate exhibiting improved durable lightfast characteristics. As used herein, the term "internal dyeing" is defined as solution dyeing, or imparting a colorant to a polymeric material to color the material throughout. The term "external dyeing" is defined as any surface dyeing, such as piece dyeing, yarn dyeing, package dyeing, or any other coloring process that changes the color of the fiber on a surface thereof.

In a preferred embodiment, polyester is solution dyed to form a base color. As described herein, the solution dye process simply includes adding a pigment, dye or other colorant to a polymeric material. The base shade must be of light enough depth and proper cast so that all desired colors can be obtained through an external dyeing process. Preferably, the base shade should provide between 70%–90% of the total depth of color of the final shade. In a broader range, the base shade may provide between 20% and 95% of the depth of color of the final shade.

Additionally in the formation process, an ultraviolet stabilizing agent is added for protection against color breakdown from extended exposure to ultraviolet light. Ultraviolet stabilizing agents are well known in the art, and any suitable one may be used. In a preferred embodiment, the ultraviolet stabilizing agent is Benzatriazole. Other suitable ultraviolet stabilizing agents may be used, including but not limited to the following: Banzatriazine, Benzaphenone, and Benzoxinane.

The solution dyed polyester is then treated with an external dye after the yarn or fabric formation process. This secondary dyeing is used to reach the final shade. A single base shade may be transformed into a wide variety of final colors by this method. When a broad spectrum of colors is desired, the use of two or more base shades may be necessary. It should be noted that any suitable synthetic substrate may be dyed in accordance with this method, even though polyester has been described herein as the preferred substrate. Additional ultraviolet protection may also be added in this step to give a layering effect.

Depending on the concentration and color of the external dye, almost infinite control of the final color shade may be exercised using the above method. The preferred methods for applying external dyes include yarn dyeing or piece dyeing.

Heretofore, because it was more economically feasible to produce solution dyed products in large quantities, the colors were limited, and the space required for inventory was much greater. Further, chances were much greater that all of a solution dyed yarn would not be used prior to a customer generated color or style change.

By providing a yarn or a substrate having a solution dyed base color that may be transformed into a wide variety of different final shades, less yarn inventory is required to supply the manufacturing pipeline. Less inventory space is required, and the process is more efficient. Material handling costs are decreased with a lower inventory, fewer stock keeping units of starting material are required, and the threat of obsolescence of the remaining inventory is diminished. Further, lightfast qualities in the final product are enhanced, and the final shade may be applied late in the fabric formation process, allowing quick response to customer color orders.

An unexpected benefit of the described process was a decrease in shade variation of the final product when starting with the aforementioned base yarn. This was found to occur due to lower levels of variation in solution dyed yarns as compared to greige yarns, with no detectable difference in dye uptake properties.

EXAMPLE 1

An experiment was performed to compare the lightfast characteristics of socks dyed in accordance with the present invention versus socks dyed in a standard piece dyeing process. The results are as follows:

TABLE 1

| | Medium Neutral | | Burgundy | | Graphite | |
|---|---|---|---|---|---|---|
| Color | White Sock | Gray Sock | White Sock | Gray Sock | White Sock | Gray Sock |
| Trial 1* | 3.4 | 1.66 | 2.79 | 1.96 | 1.38 | 0.96 |
| Trial 2* | 3.13 | 1.33 | 2.31 | 1.39 | 1.76 | 0.9 |
| Trial 3* | 2.18 | 0.85 | | 2.15 | 2.69 | 1.76 |
| Average | 2.9 | 1.28 | 2.55 | 1.83 | 1.94 | 1.21 |
| Improved ΔE | | 1.62 | | 0.72 | | 0.73 |
| Improved % | | 56% | | 28% | | 38% |
| Dye Reduction | | approx. 29% | | approx. 14% | | approx. 20% |

*These measurements are the change in ΔE (visual color change) at 225 kJ, comparing light exposure of the exposed versus the nonexposed sample.

This test was performed according to the standard test method SAEJ1885 and SAEJ1767. It may be seen from the above results that the hybrid combination between solution dyeing and piece dyeing results in significant improvements in lightfastness over substrates colored using the piece dyeing process alone. Further, less of the external dye was required to obtain the same final shade, resulting in a cost savings in external dyestuff.

While the present invention has been described in considerable detail with reference to certain preferred versions thereof, other versions are possible. Therefore, the spirit and scope of the appended claims should not be limited to the description of the preferred versions contained herein.

What is claimed is:

1. A method of dyeing synthetic material, said method comprising the steps of:

internally dyeing a polymeric material by means of introducing a colorant into a melt of said polymeric material, wherein said colorant provides a base color shade for said polymeric material:

producing yarn from said internally dyed polymeric material; and externally dyeing said yarn to form a final color shade thereon.

2. The method set forth in claim 1, further including the step of impregnating said polymeric material with an ultraviolet stabilizing agent.

3. The method set forth in claim 1, said base color shade provides between 70% and 90% of the total depth of color of said final color shade.

4. A fabric treated in accordance with claim 1.

* * * * *